United States Patent [19]

Dubé

[11] Patent Number: 4,507,150

[45] Date of Patent: Mar. 26, 1985

[54] REMOVAL OF IMPURITIES FROM MOLTEN ALUMINIUM

[75] Inventor: Ghyslain Dubé, Jonquiere, Canada

[73] Assignee: Alcan International Limited, Montreal, Canada

[21] Appl. No.: 550,753

[22] Filed: Nov. 10, 1983

[30] Foreign Application Priority Data

Nov. 16, 1982 [GB] United Kingdom ..... 8232661

[51] Int. Cl.[3] ..... C22B 21/00

[52] U.S. Cl. ..... 75/63; 75/68 R

[58] Field of Search ..... 75/68 R, 63

[56] References Cited

U.S. PATENT DOCUMENTS 1,921,998 8/1933 Bonsack ..... 75/68 R
3,198,625 8/1965 Stroup ..... 75/68 R
4,052,198 10/1977 Yarwood et al. ..... 75/68 R

FOREIGN PATENT DOCUMENTS 152435 11/1971 Japan ..... 75/68 R

*Primary Examiner*—M. J. Andrews
*Attorney, Agent, or Firm*—Cooper, Dunham, Clark, Griffin & Moran

[57] ABSTRACT

Ti and V impurities are removed from molten aluminium by adding a boron-bearing substance and agitating the aluminium in the presence of a dispersed chloride and/or fluoride flux active for fluxing $(Ti,V)B_2$ particles. It is preferred to perform the process by stirring the molten aluminium to generate a vortex, into which aluminium fluoride is introduced as a fluxing agent and for reaction with any alkali metal impurity present in the molten metal. The alkali metal fluoaluminate thus generated assists the fluxing of the $(Ti,V)B_2$, as does any cell electrolyte present in the molten aluminium.

10 Claims, No Drawings

REMOVAL OF IMPURITIES FROM MOLTEN ALUMINIUM

The present invention relates to the removal of metallic contaminants from molten aluminium.

It is well known that the presence of Ti, V, Cr and Zr in solid solution have an adverse effect on the properties of aluminium. These elements greatly reduce the electrical conductivity and they also have an adverse effect on cold working properties. Therefore efforts are made to remove contaminant quantities of these metals before casting a batch of conductor-grade aluminium.

In existing procedures the batch of molten metal is treated with a B-containing material, usually an Al-B master alloy, for the purpose of converting the Ti and V content of the metal to diborides, which are markedly insoluble in molten Al. The diboride particles are then allowed to settle out before casting and this is always time-consuming and reduces the production capacity of a casting centre. Additionally formation of such borides in the furnace requires that the furnace be cleaned frequently to prevent the metal in subsequent batches becoming contaminated with inclusions of non-metallic boride particles, which may be deleterious to the mechanical properties of the product formed from the cast metal. Although titanium boride in the form of extremely fine particles is frequently added to molten aluminium before casting to provide nuclei for the control of grain size, the complex titanium vanadium diborides, formed by treatment with a C-containing material for removal of contaminant quantities of Ti and V from solution in the molten metal, are too coarse to exert an effective grain-refining function.

It has already been proposed to add boron to molten Al by introducing Al-B master alloy in rod form into molten aluminium in the trough from the furnace to the casting mould. Although that technique is effective in reducing the level of Ti and V impurity in solid solution in the cast ingot, it is not possible to separate off the diboride particles from the molten metal and these remain dispersed in the ingot and consequently may be deleterious to the mechanical properties of the product.

Other methods of reducing Ti and V contamination include the introduction of a B-bearing compound, such as borax, into the reduction cell electrolyte, so that the molten metal withdrawn from the cell for transfer to a casting centre, has a greatly reduced content of dissolved Ti, V, Cr and Zr, and contains an excess of boron remaining in the aluminium. However that method is open to the objection that diboride particles tend to accumulate as a sludge at the bottom of the cell. The excess B may have adverse effects on grain refining because it is available to react with free Ti introduced by most commercial grain refiners. In yet other methods a decomposable boron compound, such as $KBF_4$, is introduced into the molten metal, either in the holding furnace or transfer crucible. This reacts with the molten aluminium to form aluminium boride and a complex salt mixture containing potassium aluminium fluoride, ($KF\text{-}ALF_3$). The thus formed aluminium boride reacts with Ti and V in the molten Al and the resultant diboride particles are settled out as in other alternatives suggested above, so that, as before, a substantial settlement time is required for the separation of the diboride particles from a batch of molten metal. The potassium aluminium fluoride remains on the surface of the molten aluminium, since it is less dense and exerts no fluxing effect on the precipitated diboride.

We have now found, in accordance with the present invention, that greatly improved separation of diboride particles from the molten aluminium can be achieved with substantially decreased treatment time by contacting a body of molten aluminium with a B-bearing material in the presence of an effective amount of a metal chloride and/or fluoride material, active for fluxing $(Ti,V)B_2$, and agitating said molten aluminium under conditions to disperse the fluxing material in particle form through the body of molten metal. As a consequence the conversion rate of the free Ti and V into diboride complexes is greatly increased and the particles of fluxing material act as collectors for the diboride particles produced under the conditions of rapid reaction due to the agitation.

The boron-bearing material is added in sufficient quantity to convert at least a major proportion of the dissolved Ti and V impurities into insoluble $(Ti,V)B_2$ complex particles. The agitation of the metal is continued for a sufficient time for collection of a major proportion of the complex diboride particles by the dispersed flux particles.

In most instances at least part of the flux will be formed in situ in the molten metal by reaction of added $AlF_3$ with alkali metal impurities in the molten metal. However some or all the flux may be due to cryolitic electrolyte drawn off from the reduction cell with the molten metal.

In U.S. patent application Ser. No. 456,271 now U.S. Pat. No. 4,470,846 there is described a method for removal of Li and other alkali- and alkaline-earth metals from molten aluminium, in which a vortex is generated by means of a stirrer in a body of molten metal, for example in a transfer crucible, and an $AlF_3$-bearing material is introduced onto the surface of the molten metal and is thus dispersed and recirculated through the molten metal by the flow currents associated with the generation of the vortex. As a result of the stirring to generate the vortex flow currents are established in the molten metal having radially outward components in the bottom of the crucible and upward components in the region of the peripheral wall. In the upper part of the molten metal there are currents leading inwardly to the vortex.

In that procedure the alkali- and alkaline-earth metal contaminants due to components in the cell electrolyte are converted into fluoaluminates by reaction with the introduced or in situ formed aluminium fluoride (including double fluorides having a high proportion of $AlF_3$ by weight). The resultant fluoaluminate reaction products are effective flux particles to act as collectors for the solid particles of titanium (vanadium) diboride, which result from the treatment of molten aluminium under conditions of high agitation by the method of the invention. Typically the active cryolitic flux particles have a lower apparent density than liquid Al, even after collection of the denser diboride particles, so that they separate relatively easily from the molten metal and usually form a deposit on the refractory wall of the crucible or a supernatant layer where it can be removed either by crucible cleaning or by skimming.

The $(Ti, V)B_2$ is formed of fine particles mostly in a size range up to about 10 microns but with a relatively small proportion of particles in a size range up to 50 microns or even higher. The flux particles present in the molten metal typically range from 50–250 microns and preferentially wet the diboride particles, which remain solid.

The agglomerates formed by the flux particles and finer diboride particles tend to adhere to the conventional refractory lining of the crucible or other vessel by reason of the wetting of the refractory by the flux.

It will thus be seen that the process of the present invention is very conveniently carried out in conjunction with the treatment of the molten metal with aluminium fluoride-containing material for removal of lithium and other alkaline and alkaline-earth metals. Such an operation is normally only required where lithium fluoride forms a minor component in the reduction cell electrolyte. In other cases, where a lithium-removal treatment is unnecessary, reliance may be placed on molten fluoaluminate fluxing particles to collect the solid diboride particles for removal from the system. In the case of molten metal withdrawn from a reduction cell the inevitable cryolitic electrolyte droplets carried over in the molten metal may serve this purpose. In other cases, where the batch of molten metal is obtained by remelting, a fluoaluminate or other suitable flux may conveniently be introduced either in the melting or holding furnace or in the transfer crucible or equipment.

All the varying forms of apparatus described in said United States Patent Application may be employed for the present purpose irrespective of whether there is an addition of aluminium fluoride or separate quantity of fluoaluminate flux or whether carried-over cryolitic electrolyte is solely relied on to perform the fluxing function.

Where no separate addition of flux is made the diboride reaction product may be dispersed through the molten metal for contact with the fluoaluminate flux particles by other agitation systems such as electromagnetic stirring, gas injection or conventional mechanical stirring.

The addition of the boron-bearing material to the crucible, in which the treatment is to be performed, is most conveniently achieved by addition of an aluminium-boron master alloy. These alloys in fact comprise a dispersion of fine aluminium boride particles in an aluminium matrix, so that the addition of such master alloy effectively constitutes an addition of aluminium boride, the aluminium matrix being melted away.

According to the method of manufacture and boron content of such master alloy the boron is preponderantly in the form of a diboride $AlB_2$ or dodecarboride $AlB_{12}$.

An alternative route for the addition of boron to the molten metal is to add $KBF_4$ which will form aluminium boride in situ by reaction with the molten metal. In such case, because of the molten metal temperature, the resultant boride is expected to be largely in the form of $AlB_2$. Where a lithium-removal treatment is being applied $KBF_4$ and $AlF_3$ particles may be introduced into the crucible in admixture with each other or $KBF_4$ alone, since this will generate $AlF_3$ by reaction with Al metal in the crucible.

In the procedure of the present invention it is desirable that the treatment time required for reduction of Ti and V to a desired low level (below 10–20 p.p.m. of each element) should be relatively short and consistent with the treatment time required for reduction of the Li level by treatment with $AlF_3$. We have found that to achieve the desired low level of Ti and V (to permit use of the metal as electrical grade aluminium) within a short treatment time, (such as ten minutes), it is preferred for consistently acceptable results to introduce boron (in the form of an Al-B master alloy) in an amount exceeding the stoichiometric quantity required for conversion of the free Ti and V to diboride. In calculating the boron addition the Cr and Zr content is normally ignored, since the quantity of these elements in primary metal from the electrolytic reduction cell is usually of the order of 10 p.p.m. or less. In any case where larger quantities of Cr and Zr are present, these would require to be taken into account, since these also precipitate as insoluble diborides. The upper limit of the desirable excess is set both by economic considerations (cost of the Al-B master alloy) and the maximum permissible level of free boron in the eventual product metal. These considerations effectively limit the acceptable upper level of boron addition. The level of B in the product metal should be no more than 200 p.p.m. preferably below 100 p.p.m.

In most instances a B-bearing substance will be added in a total amount of 0.005–0.020% B to the molten aluminium. Where $AlF_3$ is added this will usually be at the rate of 0.02–0.2% (0.2–2 Kgs. $AlF_3$/tonne Al).

EXAMPLE 1

In one series of experiments boron in the form of Al-4%B master alloy was introduced into a batch of molten aluminium, drawn from an electrolytic reduction cell. The master alloy was melted on the surface of the batch of molten aluminium held in a transfer crucible. A vortex was then generated in the molten metal by means of an eccentrically-located impeller constructed and arranged as described in U.S. patent application Ser. No. 456,271 and particulate aluminium fluoride was then introduced into the crucible in amounts of 0.5 Kg. and 1.0 Kg. per tonne Al. Stirring by means of the impeller was continued for 10 minutes, which was sufficient to reduce the Li, Na and Ca contents of the molten metal to an acceptable level.

In this series of experiments different quantities of Al-4%B master alloy were added and also different quantities of aluminium fluoride. The temperature of the melt before and after the treatment was recorded and the content of free Ti, V and B before and after treatment was estimated by state-of-the-art spectrometric techniques. The results of these experiments are recorded in Table 1.

TABLE 1

TREATMENT TIME: 10 MIN. CRUCIBLE CAPACITY: 4800 KG

| Test | Temperature (°C.) | | | $AlF_3$ | Ti (ppm) | | V (ppm) | | B (ppm) | | Ratio B addition/ Stoichiometric |
|---|---|---|---|---|---|---|---|---|---|---|---|
| No. | Before | After | % B addition | Kgs/tonne | Before | After | Before | After | Before | After | requirement |
| 1 | 822 | 793 | .014 | 0.5 | 34 | <10 | 28 | <10 | <10 | 50 | 5.05 |
| 2 | 757 | 736 | .007 | 1.0 | 42 | 10 | 55 | 10 | <10 | <10 | 1.63 |
| 3 | 888 | 869 | .010 | 0.5 | 42 | <10 | 52 | 10 | <10 | 40 | 2.40 |
| 4 | 843 | — | .010 | 0.5 | 46 | <10 | 59 | <10 | <10 | 40 | 2.15 |

TABLE 1-continued

| TREATMENT TIME: 10 MIN. CRUCIBLE CAPACITY: 4800 KG | | | | | | | | | | | |
|---|---|---|---|---|---|---|---|---|---|---|---|
| Test No. | Temperature (°C.) Before | After | % B addition | $AlF_3$ Kgs/tonne | Ti (ppm) Before | After | V (ppm) Before | After | B (ppm) Before | After | Ratio B addition/ Stoichiometric requirement |
| 5 | 820 | 795 | .014 | 1.0 | 41 | <10 | 60 | <10 | <10 | 60 | 3.13 |

The treated product was examined to determine the size and number of residual (Ti, V)$B_2$ complex particles present, and these are compared with representative results for the commonly employed methods for reducing Ti and V levels in aluminium. The present process, as a result of the collecting effect of the $AlF_3$ flux addition, leads to considerably improved melt cleanliness results, as may be seen in Table 2.

TABLE 2

| (Ti-V)$B_2$ COMPLEX - SIZE DISTRIBUTION - No/cm$^2$ | | | | | | | |
|---|---|---|---|---|---|---|---|
| Test No. | <5 μm | 6–10 μm | 11–20 μm | 21–30 μm | 31–50 μm | >50 | Total |
| 2 | 18 | 15 | 4 | 1 | 2 | 0.1 | 40.1 |
| 3 | 9 | 6 | 2 | 0.2 | 0.2 | 0.06 | 17.5 |
| 4 | 25 | 12 | 3 | 1 | 1 | 0.4 | 42.4 |
| 5 | 42 | 11 | 4 | 2 | 0.5 | 0.4 | 59.9 |
| Furnace settled, using Al 4% B alloy at 90 ppm. B addition | 145 | 35 | 40 | 20 | 7 | 1 | 248 |
| Trough addition Al 3% B rod 90 ppm. B | 160 | 90 | 51 | 16 | 2 | 1 | 320 |

Molten aluminium treated by this process ($AlF_3$+B addition) is effectively free of Li, Na, Ca, contains very little Ti or V in solution and very small amounts of (Ti, V) $B_2$small inclusions. Also, the metal is cleansed from aluminium carbide, oxides or other solid non-metallic inclusions due to the excellent fluxing properties of the active aluminium fluoride content of the cryolite-rich material.

Because the treatment time is rapid (~5–10 min.) and all the operations can be performed directly in the same crucible, this process offers important economic advantages. It can also be incorporated into existing hot metal handling system with minimum extra costs.

In most instances, owing to the pull-over of electrolyte from the reduction cell, there is adequate fluoaluminate flux in the crucible to collect the precipitated diboride particles and to cleanse the metal from the non-metallic particles mentioned above. However where the process is applied to remelted ingot it is preferred that fluoaluminate flux should be added in amount of 0.2 Kgs/tonne.

EXAMPLE 2

Molten aluminium, containing between 40–50 p.p.m. Ti and 90–110 p.p.m. V was treated directly in a 3.5 reduction cell syphoning crucible before transfer to a 45 t stationary holding furnace. An Al-3% B master alloy was added to the crucible, at an equivalent B concentration of 0.012% B. A vortex was generated in the molten aluminium using the same stirring system as in Example 1 and 1.5 kg $AlF_3$/t Al was introduced into the crucible. The stirring was continued for six minutes. After each crucible treatment, the metal was transferred into the furnace. After charging, the furnace content was cast by conventional direct chill (D.C.) casting without a further settling period at a flow rate of 400 kg/min. The metal was sampled in the trough between the holding furnace and the casting mould during casting and analyzed. The titanium concentration was less than 10 p.p.m. and the vanadium concentration varied between less than 10 and 20 p.p.m. The cast product was examined microscopically to determine metal cleanliness. The metal contained only a trace of residual (Ti,V)$B_2$ compounds, and was essentially free from oxides, aluminium carbide and other non-metallic inclusions due to the good cleaning action of the aluminium fluoride treatment.

EXAMPLE 3

Molten aluminium withdrawn from the reduction cell was treated directly in the 3.5 t syphoning crucible, using stirring equipment identical to Example 1, for a period of six minutes. The metal temperature varied from 725° C. to 850° C. Boron was added to the metal using an Al-3% B master alloy, in concentrations equivalent to 0.006% B and 0.008% B before stirring. Titanium and vanadium concentration percent before and after the stirring treatment, with and without $AlF_3$ addition, is shown in the following Table 3.

TABLE 3

| | No $AlF_3$ Addition | | 1.5 kg $AlF_3$/t | |
|---|---|---|---|---|
| B Addition | Before stirring | After stirring | Before stirring | After stirring |
| 0.006% | Ti = 0.005 | <0.001 | Ti = 0.005 | <0.001 |
| | V = 0.009 | 0.002 | V = 0.009 | 0.002 |
| 0.008% | Ti = 0.005 | <0.001 | Ti = 0.005 | <0.001 |
| | V = 0.009 | 0.002 | V = 0.009 | 0.002 |

In the example with no $AlF_3$ addition the residual electrolyte material acted as cleaning flux for the removal of non-metallic inclusions from the liquid aluminium. However, alkali- and alkaline-earth metal elements and aluminium carbide inclusion concentrations remained higher after stirring without $AlF_3$ addition compared to treatment in the presence of an $AlF_3$ flux.

The amount of cryolitic electrolyte present in the metal withdrawn from the reduction cell was estimated as being between 0.1% and 1.0% by weight.

All percentages herein are percentages by weight.

In the foregoing description the materials described for fluxing the (Ti,V)$B_2$ particles are $AlF_3$ and sodium fluoaluminate containing NaF and $AlF_3$ in proportions typical of the electrolyte employed in an electrolytic reduction cell for production of aluminium.

However, as is well known in the art, many different salt compositions may be employed for fluxing molten aluminium and would be suitable for the present purpose. Thus mixtures of alkali metal- and alkaline earth metal-chlorides and/or fluorides, may be employed. Where chlorides and fluorides are mixed, the fluoride content is preferably held below 50%. Also mixtures of one or more alkali metal- and/or alkaline earth metal-chlorides with up to 40% aluminium chloride may be used.

As a further alternative other alkali metal fluoaluminates may be employed in place of sodium fluoaluminates. Where a fluoaluminate is employed one or more alkali metal- and/or alkaline earth metal-chloride or fluoride may be used in conjunction with it.

I claim:

1. A process for the removal of dissolved Ti and V impurities from molten aluminium which comprises contacting a body of molten aluminium with a boron-bearing material in the presence of a metal chloride and/or fluoride material, active for fluxing $(Ti, V)B_2$, and agitating said molten aluminium under conditions effective to disperse said fluxing material in particle form through the body of molten aluminium, said boron-bearing material being added in amount sufficient to convert at least a major portion of the dissolved Ti and V impurities into insoluble $(Ti, V)B_2$ complex particles, the agitation of the molten metal being continued for a time sufficient, and said fluxing material being present in an amount effective, for collection of a major proportion of the complex diboride particles by the dispersed flux particles.

2. A process as claimed in claim 1 in which said flux comprises aluminium fluoride and/or an alkali metal fluoaluminate.

3. A process as claimed in claim 1 further comprising generating at least a part of the flux in situ by addition of aluminium fluoride for reaction with alkali- or alkaline earth metal-impurities present in the molten aluminium.

4. A process as claimed in claim 1 in which the agitation of the body of aluminium is effected by generation of a vortex therein.

5. A process as claimed in claim 1 in which the boron-bearing material is an aluminium-boron master alloy.

6. A process according to claim 1 in which the boron-bearing material is added in more than stoichiometric quantity for reaction with the total Ti and V content of said molten aluminium but in insufficient quantity to provide a free boron content in excess of 200 p.p.m. in the aluminium after said treatment.

7. A process according to claim 1 in which at least a part of the flux is constituted by cryolitic electrolyte present in the molten aluminium when withdrawn from an electrolytic reduction cell.

8. A process as claimed in claim 1 in which a B-bearing substance is added in an amount to introduce 0.005–0.020% B into said molten aluminium.

9. A process according to claim 3 in which aluminium fluoride is added in amount of 0.02–0.2% of the molten aluminium.

10. A process according to claim 4 in which aluminium fluoride is added in amount of 0.02–0.2% of the molten aluminium.

* * * * *